US009410781B1

(12) United States Patent
Hooke et al.

(10) Patent No.: US 9,410,781 B1
(45) Date of Patent: Aug. 9, 2016

(54) FIN-STABILIZED, MUZZLE-LOADED MORTAR PROJECTILE WITH SABOT

(71) Applicants: Ryan Hooke, Bangor, PA (US); Jackie Longcore, Augusta, NJ (US); Kyle Schaarschmidt, Bangor, PA (US); Joshua Gallagher, Hackettstown, NJ (US)

(72) Inventors: Ryan Hooke, Bangor, PA (US); Jackie Longcore, Augusta, NJ (US); Kyle Schaarschmidt, Bangor, PA (US); Joshua Gallagher, Hackettstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 37 days.

(21) Appl. No.: 14/444,415

(22) Filed: Jul. 28, 2014

(51) Int. Cl.
*F42B 14/06* (2006.01)
*F42B 10/06* (2006.01)

(52) U.S. Cl.
CPC ..... *F42B 14/067* (2013.01); *F42B 10/06* (2013.01); *F42B 14/061* (2013.01); *F42B 14/06* (2013.01)

(58) Field of Classification Search
CPC ..... F42B 14/067; F42B 14/061; F42B 10/06; F42B 14/06; F42B 14/062; F42B 14/064
USPC ..... 102/520–523
See application file for complete search history.

(56) References Cited

U.S. PATENT DOCUMENTS

| | | | | | |
|---|---|---|---|---|---|
| 3,687,079 | A * | 8/1972 | Scollins | F42B 14/02 | 102/373 |
| 4,142,467 | A * | 3/1979 | Stahlmann | F42B 14/08 | 102/523 |
| 4,244,293 | A * | 1/1981 | Grosswendt | F41A 1/10 | 102/374 |
| 4,314,510 | A * | 2/1982 | Jeter | F42B 14/064 | 102/521 |
| 4,936,220 | A * | 6/1990 | Burns | F42B 14/061 | 102/374 |
| 4,949,639 | A * | 8/1990 | Burns | F42C 15/36 | 102/249 |
| 8,250,988 | B2 * | 8/2012 | Heitmann | F42B 14/064 | 102/520 |
| 8,434,394 | B1 * | 5/2013 | Malejko | F42B 10/14 | 102/374 |
| 8,561,544 | B2 * | 10/2013 | Baumann | F42B 14/064 | 102/523 |
| 2010/0000439 | A1 * | 1/2010 | Baumann | F42B 14/064 | 102/521 |

* cited by examiner

*Primary Examiner* — Samir Abdosh
*Assistant Examiner* — John D Cooper
(74) *Attorney, Agent, or Firm* — Michael C. Sachs

(57) ABSTRACT

A muzzle-loaded, fin-stabilized mortar round includes a projectile with a discarding sabot mounted thereon. The sabot includes one or more discrete sections that are circumferentially divided into a plurality of discrete sabot increments. In the case of more than one discrete section, the plurality of discrete sections are arranged longitudinally one after another in abutting relationship. Each sabot increment includes a base portion mechanically connected to the projectile and two opposing side portions mechanically connected to circumferentially adjacent sabot increments.

5 Claims, 12 Drawing Sheets

C 80
82
84
86

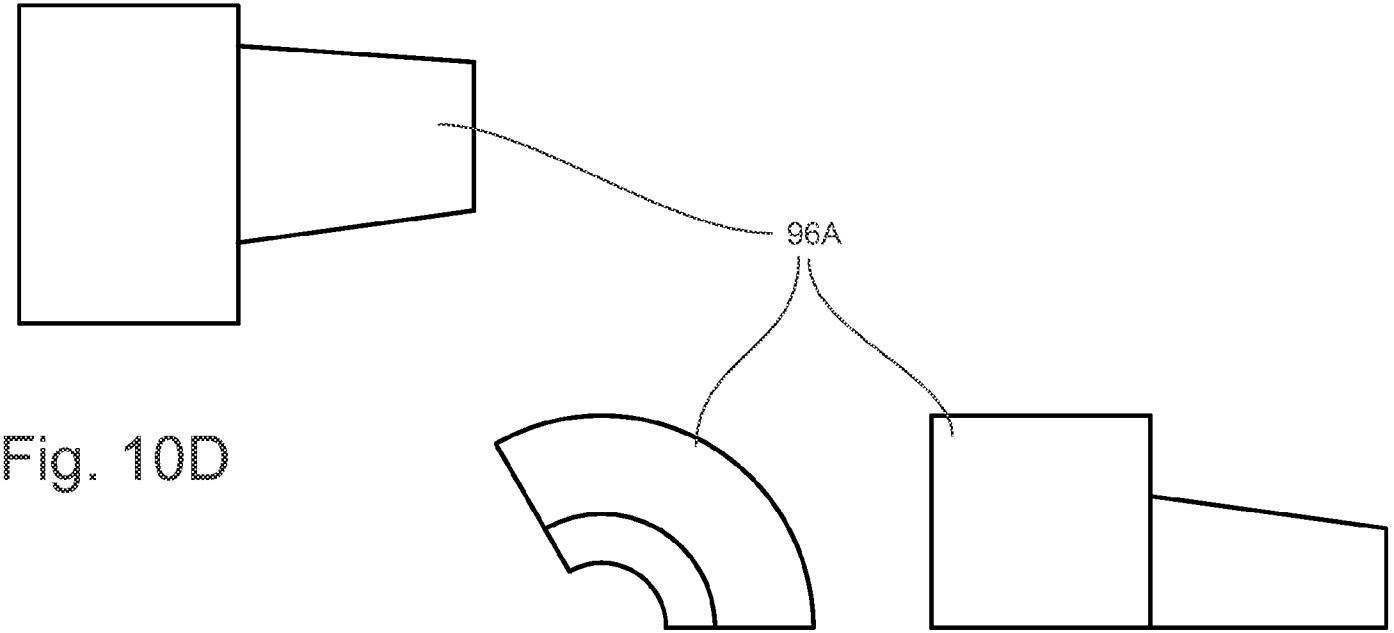
Fig. 10D
Fig. 10C
Fig. 10B
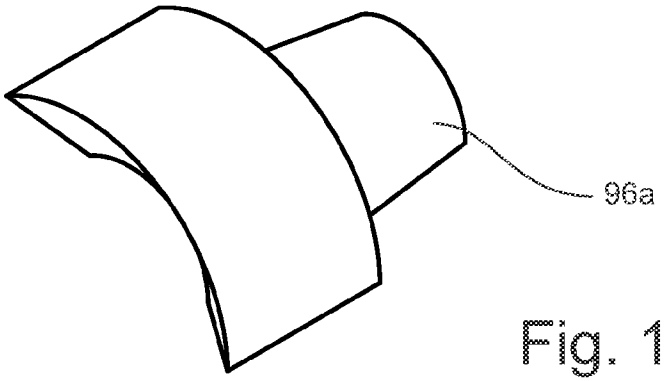
Fig. 10A

FIN-STABILIZED, MUZZLE-LOADED MORTAR PROJECTILE WITH SABOT

STATEMENT OF GOVERNMENT INTEREST

The inventions described herein may be manufactured, used and licensed by or for the United States Government.

BACKGROUND OF THE INVENTION

The invention relates in general to munitions and in particular to muzzle-loaded mortar projectiles.

Fin-stabilized, muzzle-loaded mortar projectiles may be fired from smooth bore or rifled tubes. Various means have been used with fin-stabilized projectiles to seal the propellant gas and thereby create the high pressure needed to propel the mortar projectile out of the mortar tube and down range. Obturators and grease grooves are some of the sealing means that have been used.

Some breech-loaded, smooth-bore projectiles, such as tank ammunition, use a sabot as the sealing or obturating device. The U.S. Army has used a 22 mm sub-caliber projectile with an 81 mm sabot (MI) as a training round. U.S. Pat. No. 3,430,572 issued to Hebert et al. on Mar. 4, 1969 discloses a disintegrating sabot for a fin-stabilized projectile. U.S. Pat. No. 4,318,344 issued to Price et al. on Mar. 9, 1982 discloses a spinning tubular projectile with a combustible sabot. U.S. Pat. No. 4,711,180 issued to Smolnik on Dec. 8, 1987 discloses a mortar training device with simulated propelling charges and a sub-caliber flight projectile. U.S. Pat. No. 6,779,463 issued to Mutascio et al. on Aug. 24, 2004 discloses a sabot-launched delivery apparatus for a non-lethal payload.

A need exists for a saboted, fin-stabilized, muzzle-loaded mortar round that is effective for warfare.

SUMMARY OF INVENTION

One aspect of the invention is a muzzle-loaded, fin-stabilized mortar round for launching from a mortar tube of a certain caliber. The round includes a projectile having an interior volume defined by a projectile wall. A payload is disposed in the interior volume. A tail boom is fixed to an aft portion of the projectile. A fin assembly is fixed to an aft portion of the tail boom.

A discarding sabot is disposed circumferentially around the projectile. The sabot includes a plurality of discrete sections arranged longitudinally one after another in abutting relationship and around the projectile. Each of the discrete sections is circumferentially divided into a plurality of discrete sabot increments. Each sabot increment includes a base portion mechanically connected to the projectile, two opposing side portions mechanically connected to circumferentially adjacent sabot increments, and at least one end portion mechanically connected to a longitudinally adjacent sabot increment.

In some embodiments of the mortar round, the projectile has an asymmetric shape.

In other embodiments, the mortar round includes a central longitudinal axis and the projectile is a sub-caliber projectile centered on the central longitudinal axis. The fin assembly may have a diameter at least as large as the caliber of the mortar tube. The discarding sabot may be centered on the central longitudinal axis.

The sub-caliber projectile may include a plurality of circumferential grooves formed therein. The base portion of each sabot increment may include a mating projection that is inserted in one of the plurality of circumferential grooves on the exterior surface of the sub-caliber projectile to thereby mechanically connect the base portion of the sabot increment to the sub-caliber projectile.

Rather than circumferential grooves, the exterior surface of the sub-caliber projectile may include a plurality of dimples formed therein. The base portion of each sabot increment may include mating dimples that engage some of the plurality of dimples on the exterior surface of the sub-caliber projectile to thereby mechanically connect the base portion of the sabot increment to the sub-caliber projectile.

One of the two opposing side portions of a sabot increment may include a trapezoidal projection and the other of the two opposing side portions may include a mating trapezoidal recess. Circumferentially adjacent sabot increments may be mechanically connected by inserting the trapezoidal projection of one sabot increment into the mating trapezoidal recess in a circumferentially adjacent sabot increment.

Non-parallel sides of the trapezoidal projection may each include a curved projection thereon. Non-parallel sides of the mating trapezoidal recess may each include a mating curved recess therein. The curved projection and the mating curved recess may be, for example, spherical surfaces.

Each sabot increment may have two opposing end portions. One opposing end portion may have a projecting ridge formed thereon and the other opposing end portion may have a mating groove formed therein. Longitudinally adjacent sabot increments may be mechanically connected by inserting the projecting ridge of one sabot increment into the mating groove in a longitudinally adjacent sabot increment.

The projecting ridge may include a plurality of depressions formed thereon and the mating groove may include a plurality of protuberances formed therein. The plurality of protuberances may be nested in respective ones of the plurality of depressions.

Another aspect of the invention is a muzzle-loaded, fin-stabilized mortar round for launching from a mortar tube having a certain caliber. The round includes a central longitudinal axis and a sub-caliber projectile. The sub-caliber projectile has an interior volume defined by a projectile wall and is centered on the central longitudinal axis. A payload is disposed in the interior volume. A tail boom is fixed to an aft portion of the sub-caliber projectile. A fin assembly is fixed to an aft portion of the tail boom.

A sabot is disposed circumferentially around the sub-caliber projectile and centered on the central longitudinal axis. The sabot defines an annular orifice centered on the central longitudinal axis. A plug may be inserted in an aft end of the orifice. Upon exit of the round from the mortar tube, air pressure forces the plug rearward out of the orifice.

In one embodiment, the annular orifice is an annular converging-diverging nozzle. In another embodiment, the annular orifice has a radially inward linear side and an opposing, radially outward, converging-diverging side.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 10A is a perspective view of a sabot increment of the sabot of FIG. 9A.

FIGS. 10B, 10C, and 10D are side, end and top views, respectively, of the sabot increment of FIG. 10A.

DETAILED DESCRIPTION

Figure 1A:
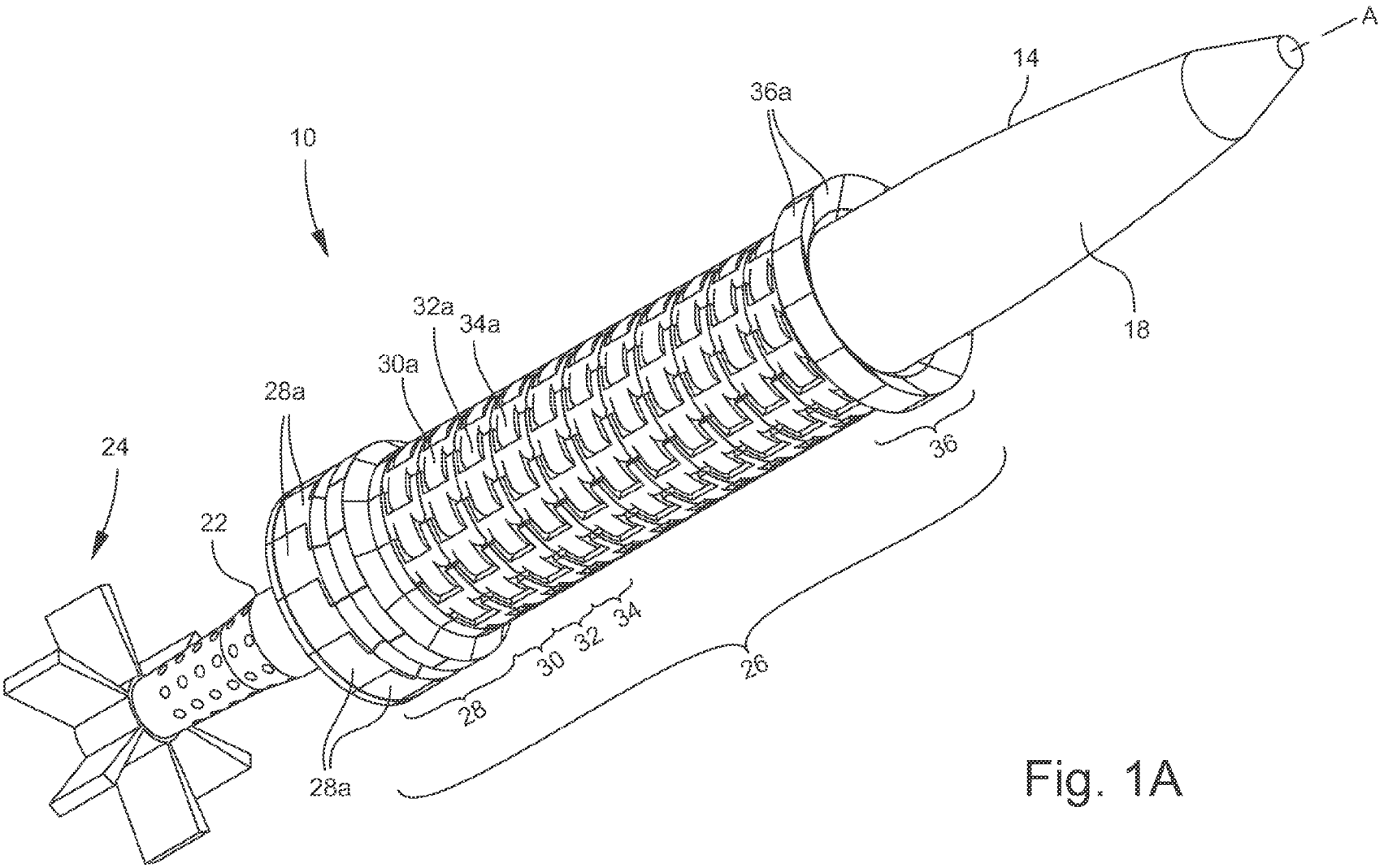
FIG. 1A is a perspective view of one embodiment of a fin-stabilized, muzzle-loaded mortar round.

A fin-stabilized, muzzle-loaded mortar round includes a sabot. The sabot functions as an obturator for the mortar round. The mortar round includes a sub-caliber projectile that is propelled toward a desired target. The sub-caliber projectile may be longer than existing projectiles and have a smaller diameter than existing projectiles, thereby decreasing the drag on the sub-caliber projectile and increasing its ballistic coefficient. The sabot is made of a plurality of discrete, individual pieces or increments. The sabot quickly releases or disassembles into the individual pieces after the mortar round exits the mortar launch tube. The individual pieces have small momentum and velocity, thereby reducing the probability that the pieces will injure personnel or materiel. In addition, as the sabot breaks apart, the individual pieces impart little or no disturbance to the sub-caliber projectile.

The sabot increments are packaged with the mortar round. The mortar round is accelerated by gas pressure acting on the sabot. The sabot increments may be made of for example, metallics, composite, plastics or combustible materials.

As an example, an 81 mm diameter sub-caliber projectile may be fitted with a sabot sized for a standard 120 mm mortar tube. Because 81 mm is a standard diameter mortar projectile, the novel sub-caliber 81 mm projectile may be produced on existing 81 mm production equipment with little or no modification to the existing production equipment. The sub-caliber projectile may be longer than a standard 120 mm projectile to maintain the same mass as a standard 120 mm projectile. Or, the sub-caliber projectile may have a mass that is less than a standard 120 mm projectile, depending on the range desired. Higher muzzle velocities due to lower projectile mass may result in extended projectile range. Lower aerodynamic drag due to the smaller diameter sub-caliber projectile also results in extended range.

Another analogous example is a 60 mm diameter sub-caliber projectile fitted with a sabot sized for a standard 81 mm mortar tube.

The sub-caliber projectile has an interior volume for a payload, such as an explosive charge. The size of the interior volume is dependent on the wall thickness and length of the sub-caliber projectile. Thus, the wall thickness and length of the sub-caliber projectile may be varied to increase the lethal effectiveness of the projectile. In the case of an 81 mm sub-caliber projectile, the projectile fragments may not have the same velocity as fragments from a 120 mm projectile, but the probability of a hit from a sub-caliber fragment may be increased over the zone with highest kill probability.

In one embodiment, the novel mortar round includes an 81 mm sub-caliber projectile having a projectile wall that defines an interior volume therein. A payload, such as a high explosive, is disposed in the interior volume. A tail boom is fixed to an aft portion of the sub-caliber projectile. Propelling charges for a standard 120 mm mortar round may be mounted on the tail boom in a known manner. A 120 mm mortar fin assembly is fixed to an aft portion of the tail boom. A novel sabot made of a plurality of individual increments is fixed to the sub-caliber projectile. The sub-caliber projectile will have a range that is greater than the range of the standard 120 mm projectile.

In another embodiment, the novel mortar round includes a standard 81 mm projectile, such as an M821 projectile. The projectile includes a projectile wall that defines an interior volume therein. A tail boom is fixed to an aft portion of the standard 81 mm projectile. Propelling charges for a standard 81 mm mortar round may be mounted on the tail boom in a known manner. An 81 mm mortar fin assembly is fixed to an aft portion of the tail boom. A novel sabot made of a plurality of individual increments is fixed to the standard projectile. The sabot may be of a size for launching from a 120 mm mortar tube. The standard 81 mm projectile fitted with the novel sabot will have a range that is greater than the range of the standard 81 mm projectile without the sabot.

Compared to the logistical burden of the standard 120 mm mortar system, the logistical burden of using the novel mortar round with the sub-caliber projectile and the sabot will be the same or less. For example, a 120 mm high explosive mortar round may weigh about 31 pounds while an 81 mm high explosive round with a sabot may weigh about 11 pounds. Further, the use of the super-caliber fins with the sub-caliber projectile increases the aerodynamic stability and accuracy of the sub-caliber projectile. The increased accuracy reduces the ballistic circular error probability (CEP) and may reduce the number of rounds per kill, thereby further reducing the logistical burden.

The sub-caliber projectile may have a generally cylindrical overall shape. The sabot increments are fixed to the outer surface of the sub-caliber projectile. In addition to generally cylindrical shapes, the sabot increments may be fixed to non-cylindrical, uniquely shaped projectiles, thereby enabling the launch of those uniquely shaped projectiles from known mortar tubes. Examples of non-cylindrical projectiles include asymmetric lifting bodies, for instance, bodies with geometries similar to flying wing geometries.

Figure 1B:
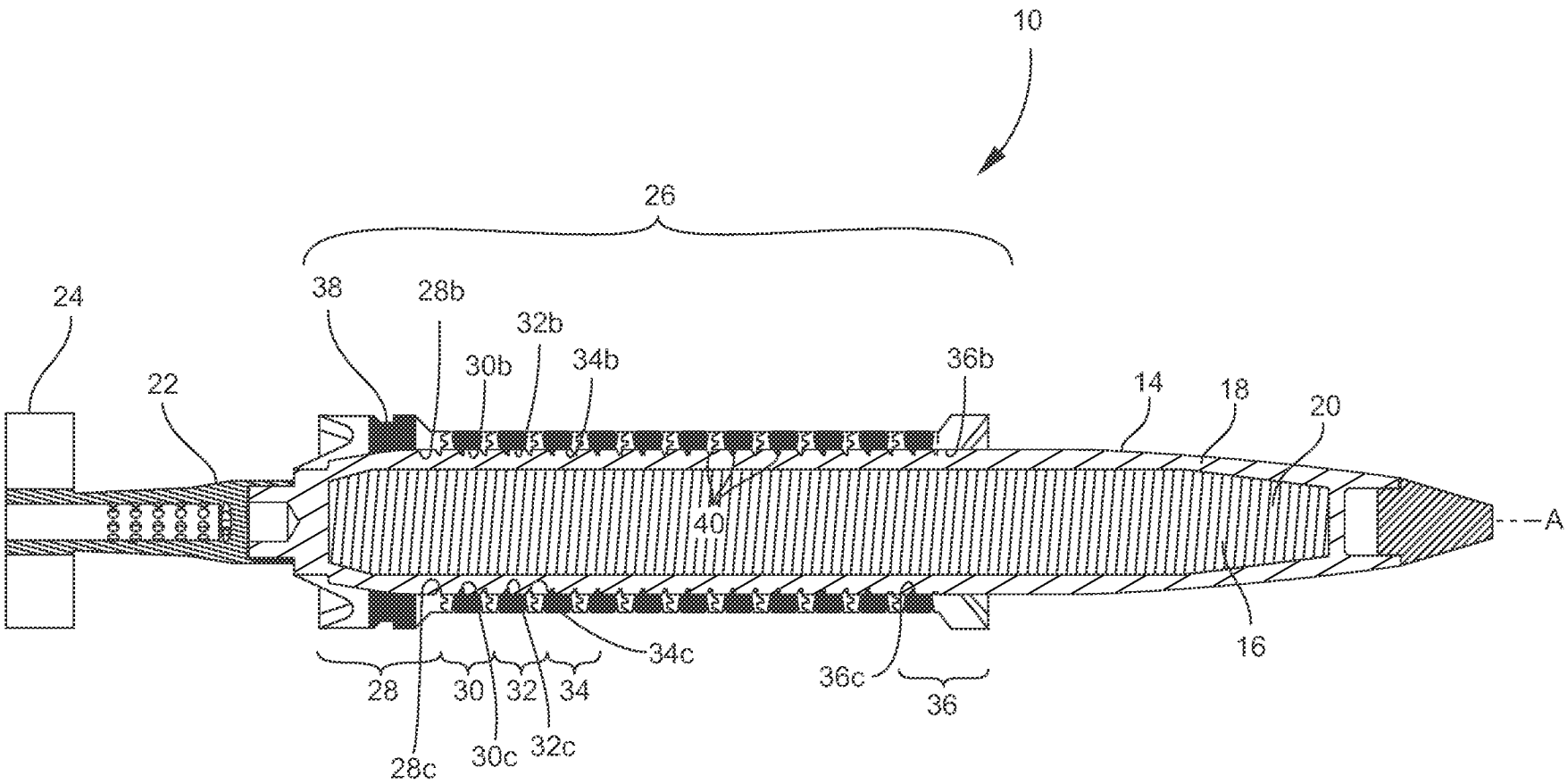
FIG. 1B is a longitudinal sectional view of FIG. 1A.
Figure 2:
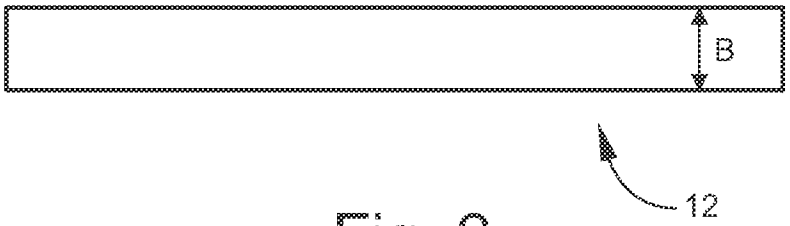
FIG. 2 is a schematic drawing of a mortar tube.
Figure 5:
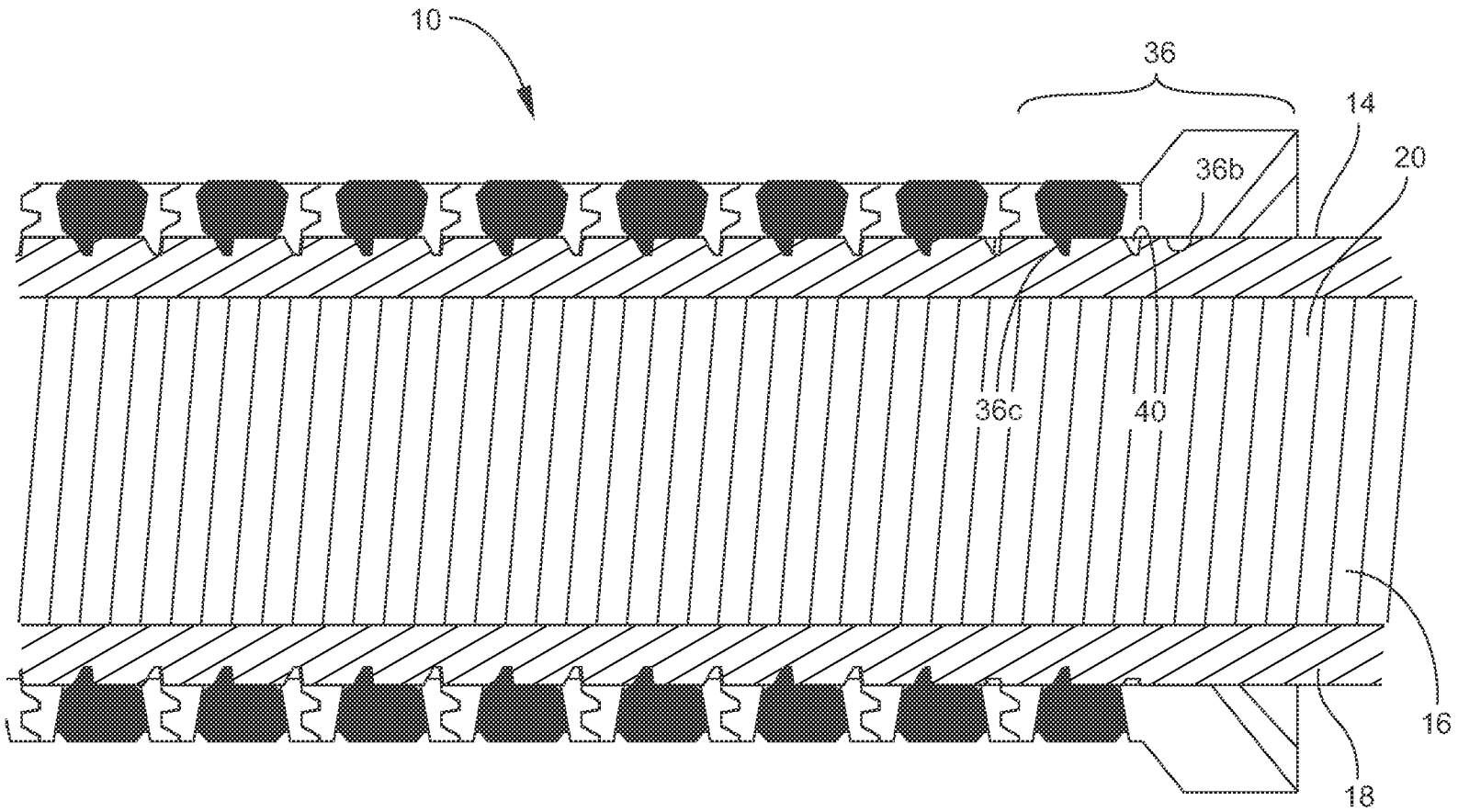
FIG. 5 is an enlarged view of a portion of FIG. 1B.

FIG. 1A is a perspective view of one embodiment of a fin-stabilized, muzzle-loaded mortar round 10 having a central longitudinal axis A. FIG. 1B is a longitudinal sectional view of FIG. 1A. FIG. 5 is an enlarged view of a portion of FIG. 1B. Round 10 may be launched from a mortar tube 12 (FIG. 2) having an inner diameter or caliber B. By way of example only, caliber B may be 120 mm or 81 mm.

Round 10 includes a sub-caliber projectile 14 having an interior volume 16 defined by a projectile wall 18. Projectile 14 may be centered on axis A. Sub-caliber means that the caliber or diameter of projectile 14 is less than caliber B. For example, if caliber B is 120 mm, projectile 14 may be an 81 mm caliber projectile, or, if caliber B is 81 mm, projectile 14 may be a 60 mm caliber projectile. Caliber B may be other sizes, also.

A payload 20 is disposed in the interior volume 16. Payload 20 may be, for example, high explosive material, smoke-producing material, etc. A tail boom 22 is fixed to an all portion of the sub-caliber projectile 14. Propelling charges (not shown) may be disposed on tail boom 22 in a known manner. A fin assembly 24 is fixed to an aft portion of the tail boom 22. The fin assembly 24 has an outer diameter at least as large as the caliber B of the mortar tube 12.

A discarding sabot 26 is disposed circumferentially around the sub-caliber projectile 14 and centered on the central longitudinal axis A. Sabot 26 includes a plurality of discrete sections 28, 30, 32, 34, 36 arranged longitudinally one after another in abutting relationship and around the sub-caliber projectile 14. The discrete sections 28-36 may be generally annular in shape. In FIGS. 1A and 1B, additional discrete sections are shown between sections 34 and 36 but are not individually called out with a reference character. The number of discrete sections 28-36 in sabot 26 may vary.

The axial location of sabot 26 on projectile 14 may be varied to vary the chamber volume in mortar tube 12. Varying the chamber volume will alter the ballistic performance of projectile 14.

Each discrete section 28-36 is circumferentially divided into a respective plurality of discrete sabot increments 28*a*, 30*a*, 32*a*, 34*a*, 36*a*. The number of sabot increments per section is at least two and may be up to twenty-four or more. In the embodiment of FIGS. 1A-B, each discrete section 28-36 is circumferentially divided into twelve increments. The division of sabot 26 into discrete longitudinal sections 28-36 and into discrete increments 28*a*-36*a* in each section enables the sabot 26 to rapidly separate from the projectile 14 at muzzle exit. In addition, the relatively small size and mass of each increment 28*a*-36*a* greatly reduces the probability of the discarded increments 28*a*-36*a* causing harm to personnel or property. The small mass of each increment 28*a*-36*a* also minimizes or eliminates any disturbances that might be imparted to projectile 14 as the increments separate from the projectile at muzzle exit. Preferably, the sabot increments 28*a*-36*a* are made of a plastic material and may be formed by injection molding.

The aft most sabot section 28 may have an outer diameter about the same as the caliber B of the mortar tube to enable sealing of the propellant gases behind sabot 26. The sabot sections 30-36 forward of section 28 may have smaller outer diameters than aft most section 28. Aft most section 28 may optionally include an obturator groove 38 (FIG. 1B) for receiving an obturator (not shown).

Each sabot increment 28*a*-36*a* includes a respective base portion 28*b*-36*b* that is mechanically connected or engaged with the sub-caliber projectile 14. The propelling force of the propellant gas behind sabot 26 is transferred to projectile 14 by the mechanical engagement between base portions 28*b*-36*b* and projectile 14. Various types of mechanical engagement may be used. In the embodiment of FIGS. 1A-B, a plurality of circumferential grooves 40 are formed in the exterior surface of projectile wall 18. Projections 28*c*-36*c* on respective base portions 28*h*-36*b* of sabot increments 28*a*-36*a* engage respective grooves 40 in wall 18. In addition, each increment 28*a*-36*a* may be sized to provide a snap or interference fit on projectile wall 18. By increasing the number of sections 28-36, the amount of propelling force transferred from sabot 26 to projectile 14 may be increased.

Figure 3:
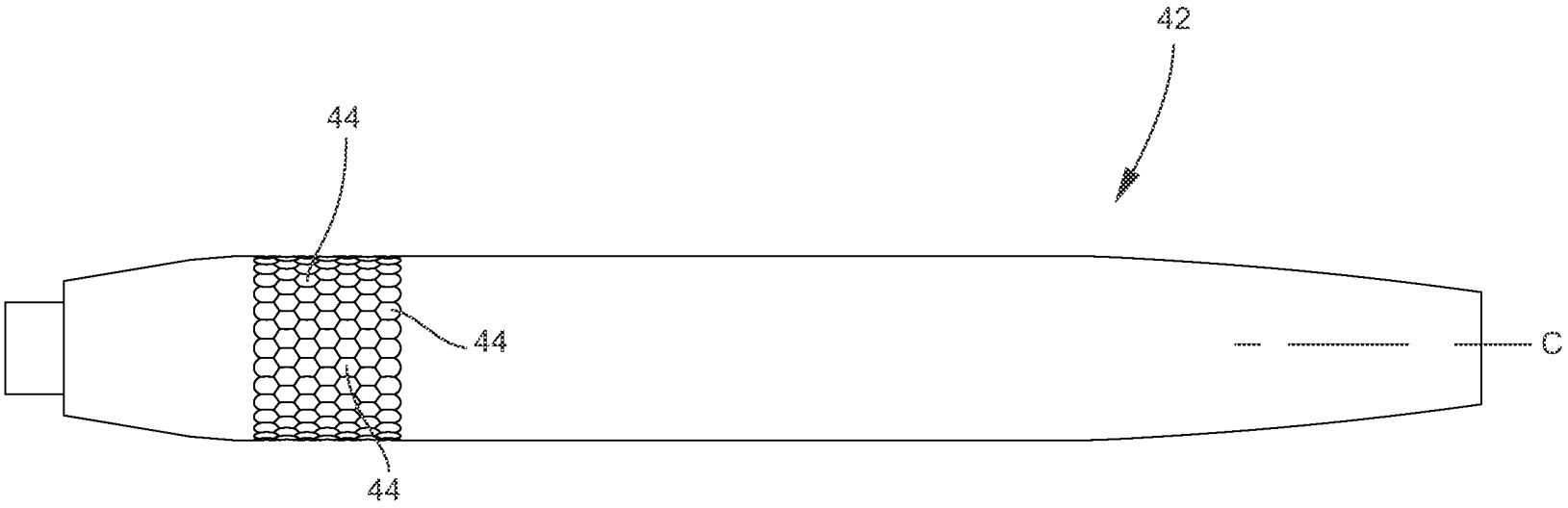
FIG. 3 is a side view of a sub-caliber projectile with dimples formed on its exterior surface.
Figures 6A, 6B, 6C, 6D, 6E, 6F, 6G, 6H, 6I:
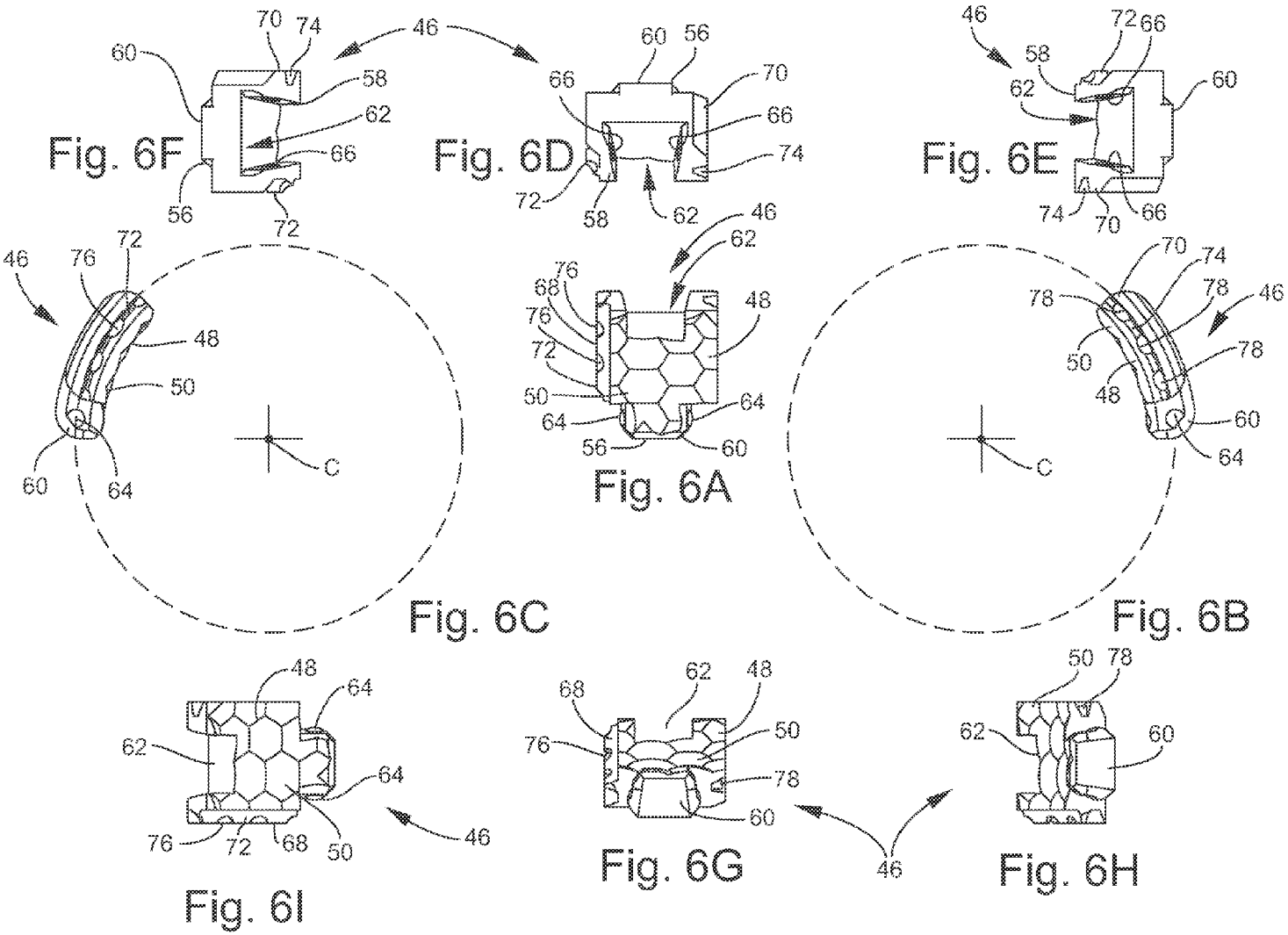
FIG. 6A is a front view of the base portion of one embodiment of a sabot increment, showing dimples formed thereon.
FIG. 6B is a right side view of FIG. 6A.
FIG. 6C is a left side view of FIG. 6A.
FIG. 6D is a top view of FIG. 6A.
FIG. 6E is a view of FIG. 6D rotated 90 degrees clockwise.
FIG. 6F is a view of FIG. 6D rotated 90 degrees counterclockwise.
FIG. 6G is an end view of FIG. 6A.
FIG. 6H is a view of FIG. 6G rotated 90 degrees counterclockwise.
FIG. 6I is a view of FIG. 6A rotated 90 degrees counterclockwise.

Another way to mechanically engage base portions of the sabot increments with projectile 14 is by forming dimples in the base portions of the sabot increments and forming mating or complementary dimples on the exterior surface of the sub-caliber projectile. FIG. 3 is a side view of a sub-caliber projectile 42 having a central longitudinal axis C. Projectile 42 has dimples 44 formed on its exterior surface. FIG. 6A is a bottom view of one embodiment of a sabot increment 46 having a base portion 48 with dimples 50 formed there. Dimples 50 on sabot base portion 48 mechanically engage dimples 44 on projectile 42 and transfer propelling force from the sabot to the projectile 14. Dimples 44, 50 may be similar in shape to dimples on golf balls.

Figure 4:
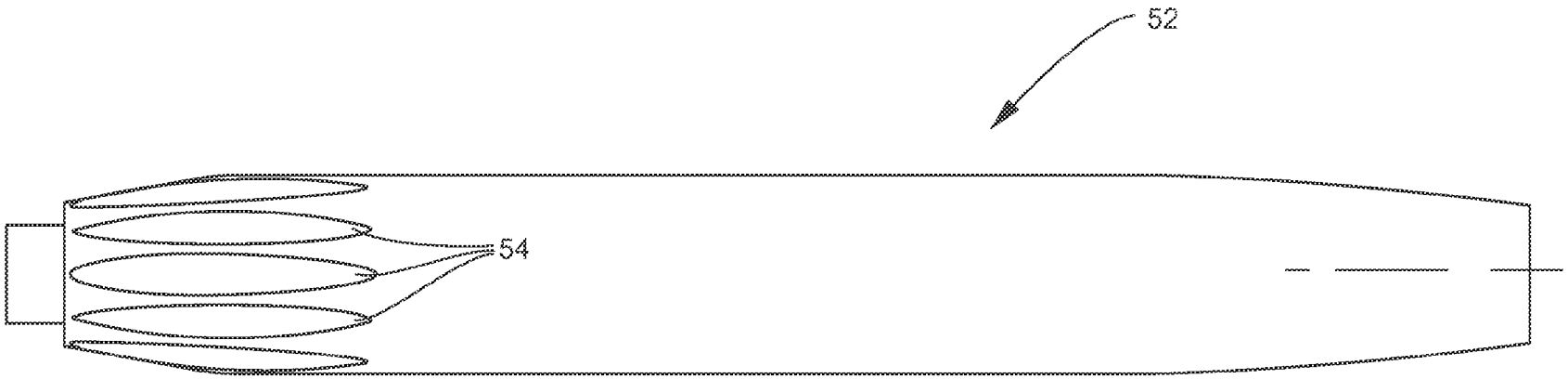
FIG. 4 is a side view of a sub-caliber projectile with longitudinal grooves formed on its exterior surface.

A further way to mechanically engage base portions of the sabot increments with projectile 14 is by forming longitudinal grooves in the exterior surface of projectile 14 and forming mating or complementary projections on the base portions of the sabot increments. FIG. 4 is a side view of a sub-caliber projectile 52 with longitudinal grooves 54 formed on its exterior surface. The base portions of the sabot increments have corresponding projections (not shown) that mate with the grooves 54.

Additional features of the sabot increments will be described with reference to sabot increment 46 shown in detail in FIGS. 6A-6I. Sabot increments 28*a*-36*a* have base portions with projections 28*c*-36*c* for engaging grooves 40, while the base portion of sabot increment 46 is dimpled. However, the circumferential and longitudinal "increment to increment" interlocking features of sabot increment 46 correspond to, for example, the structure of sabot increments 28*a*-36*a*.

FIG. 6A is a front view of the base portion 48 of sabot increment 46, showing dimples 50 formed thereon. FIG. 6B is a right side view of FIG. 6A and FIG. 6C is a left side view of FIG. 6A. FIGS. 6B and 6C show the location of the central longitudinal axis C of the dimpled sub-caliber projectile 42 (FIG. 4). Axis C is normal to the views in FIGS. 6B and 6C. The dashed circle shown in FIGS. 6B and 6C illustrates the circumferential orientation of one increment 46.

FIG. 6D is a top view of FIG. 6A. FIG. 6E is a view of FIG. 6D rotated 90 degrees clockwise. FIG. 6F is a view of FIG. 6D rotated 90 degrees counterclockwise. FIG. 6G is an end view of FIG. 6A. FIG. 6H is a view of FIG. 6G rotated 90 degrees counterclockwise. FIG. 6I is a view of FIG. 6A rotated 90 degrees counterclockwise.

Sabot increment 46 includes two opposing side portions 56, 58. The opposing side portions 56, 58 provide a mechanical connection between circumferentially adjacent sabot increments. Side portion 56 includes a trapezoidal projection 60 and side portion 58 includes a mating trapezoidal recess 62. The opposing, non-parallel sides of the trapezoidal projection 60 each include a curved projection 64 thereon. The opposing, non-parallel sides of the mating trapezoidal recess 62 each include a mating curved recess 66 therein. In one embodiment, the curved projection 64 and the mating curved recess 66 are spherical surfaces. Circumferentially adjacent sabot increments 46 are mechanically connected by inserting the trapezoidal projection 60 of one sabot increment 46 into the mating trapezoidal recess 62 of a circumferentially adjacent sabot increment 46 and nesting the curved projections 64 in the curved recesses 66.

Sabot increment 46 includes two opposing end portions 68, 70. The opposing end portions 68, 70 provide a mechanical connection between longitudinally adjacent sabot increments. One opposing end portion 68 has projecting ridge 72 formed thereon. The other opposing end portion 70 has a mating groove 74 formed therein. The projecting ridge 72 includes a plurality of depressions 76 formed thereon. The mating groove 74 includes a plurality of protuberances 78 formed therein. Longitudinally adjacent sabot increments 46 are mechanically connected by inserting the projecting ridge 72 of one sabot increment 46 into the mating groove 74 in a longitudinally adjacent sabot increment 46. In addition, the plurality of protuberances 78 in mating groove 74 are nested in respective ones of the plurality of depressions 76.

As described above, the novel sabot includes a plurality of discrete sections arranged longitudinally in series. Each section is circumferentially divided into a plurality of discrete sabot increments. The mechanical connections between the sabot increments and the sub-caliber projectile, along with the mechanical connections between circumferentially adjacent and longitudinally adjacent sabot increments, insure the effective performance of the sabot in the mortar tube. Simultaneously, the features of the sabot insure, after muzzle exit, a quick discard of the sabot into small, non-lethal pieces that have a minimal, if any, effect on the ballistics of the sub-caliber projectile.

Figures 7A, 7B, 7C, 7D, 7E:
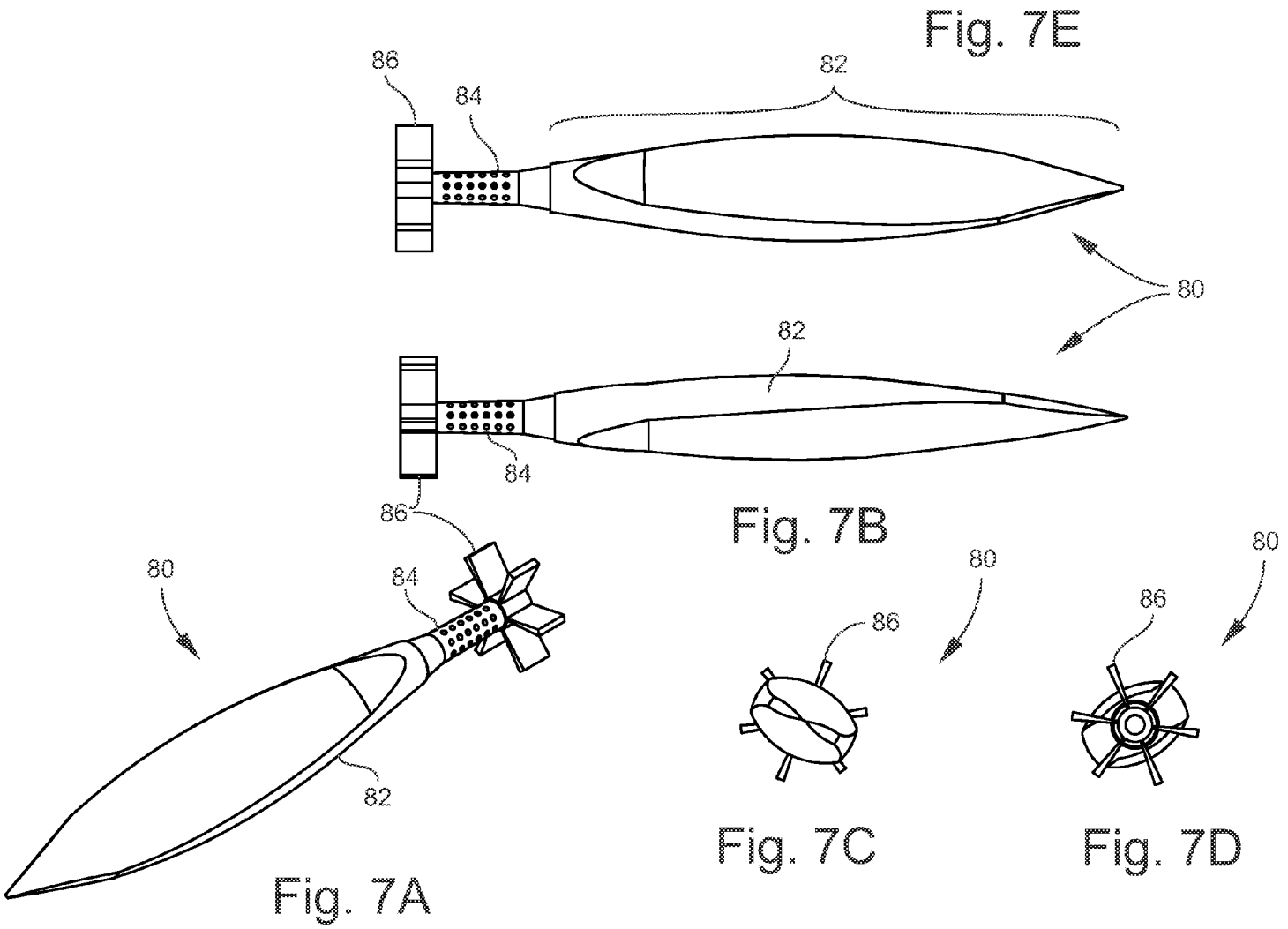
FIG. 7A is a perspective view of one embodiment of an asymmetrical, fin-stabilized, muzzle-loaded mortar projectile.
FIG. 7B-7E are side, front end, aft end, and top views, respectively, of the projectile of FIG. 7A.

FIG. 7A is a perspective view of one embodiment of an asymmetrical mortar projectile 80 having a projectile body 82, a tail boom 84, and a fin assembly 86. FIG. 7B-7E are side, front end, aft end, and top views, respectively, of the projectile 80 of FIG. 7A.

Figures 8A, 8B, 8C, 8D, 8E:
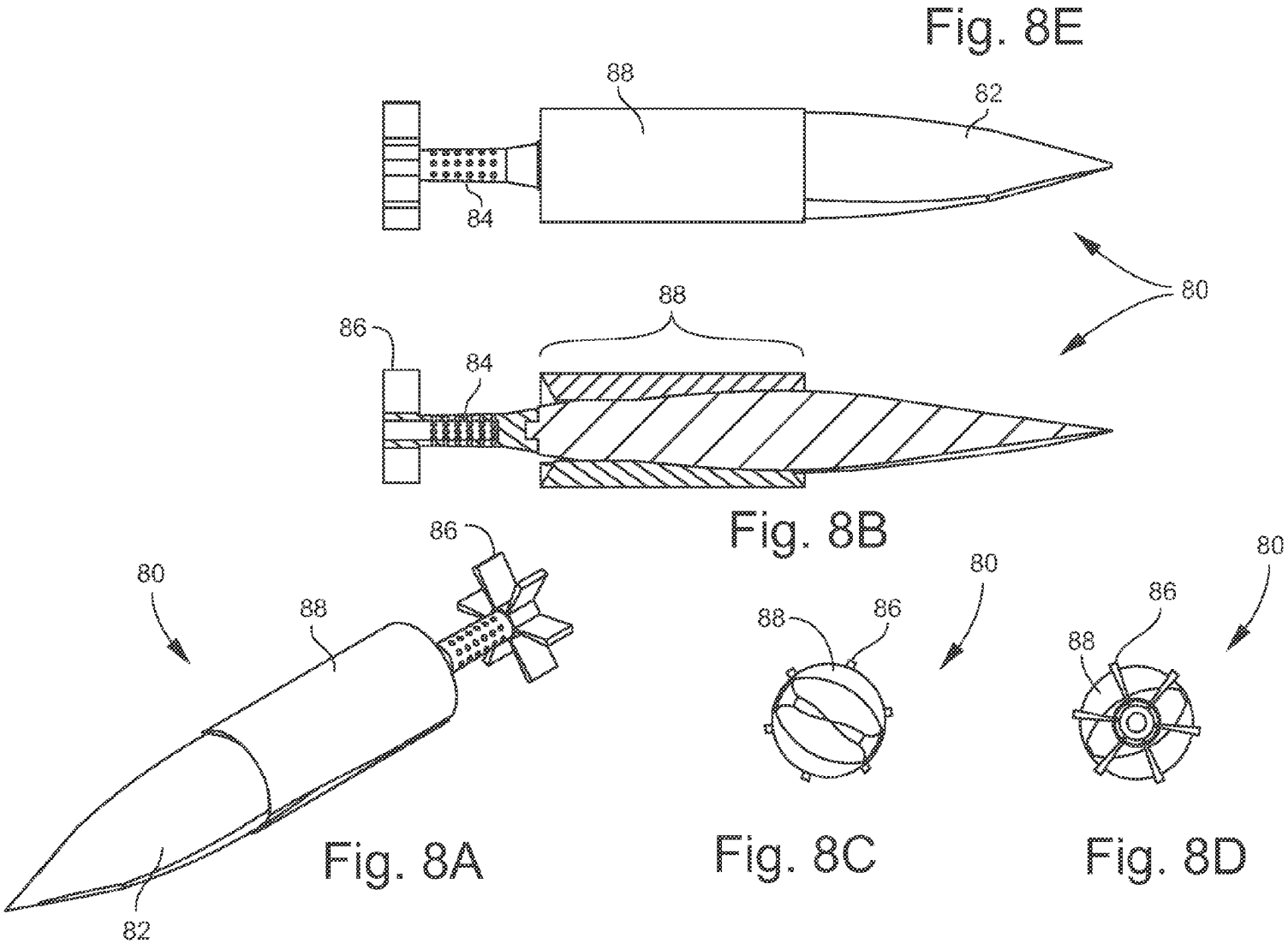
FIG. 8A is a perspective view of the projectile of FIG. 7A with a novel sabot.
FIGS. 8B-8E are longitudinal sectional, front end, aft end, and top views, respectively, of the projectile of FIG. 8A.

FIG. 8A is a perspective view of the projectile 80 of FIG. 7A with a novel sabot 88 disposed thereon. FIGS. 8B-8E are longitudinal sectional, front end, aft end, and top views, respectively, of the projectile 80 and sabot 88 of FIG. 8A. Sabot 88 is disposed circumferentially around projectile body 82. Sabot 88 may be mechanically fixed to body 82 with one or more of the structures and methods described above with respect to projectile 10 and FIGS. 1-6. As described with respect to sabot 26, sabot 88 may include a plurality of discrete sections (division lines between longitudinal sections are not shown in sabot 88) arranged longitudinally in series. Each section may be circumferentially divided into a plurality of discrete sabot increments (division lines between circumferential increments are not shown in sabot 88). The sabot increments of sabot 88 may include the mechanical features of the sabot increments of sabot 26 that enable the sabot increments to mechanically connect with circumferentially adjacent and longitudinally adjacent sabot increments.

Figure 9B:
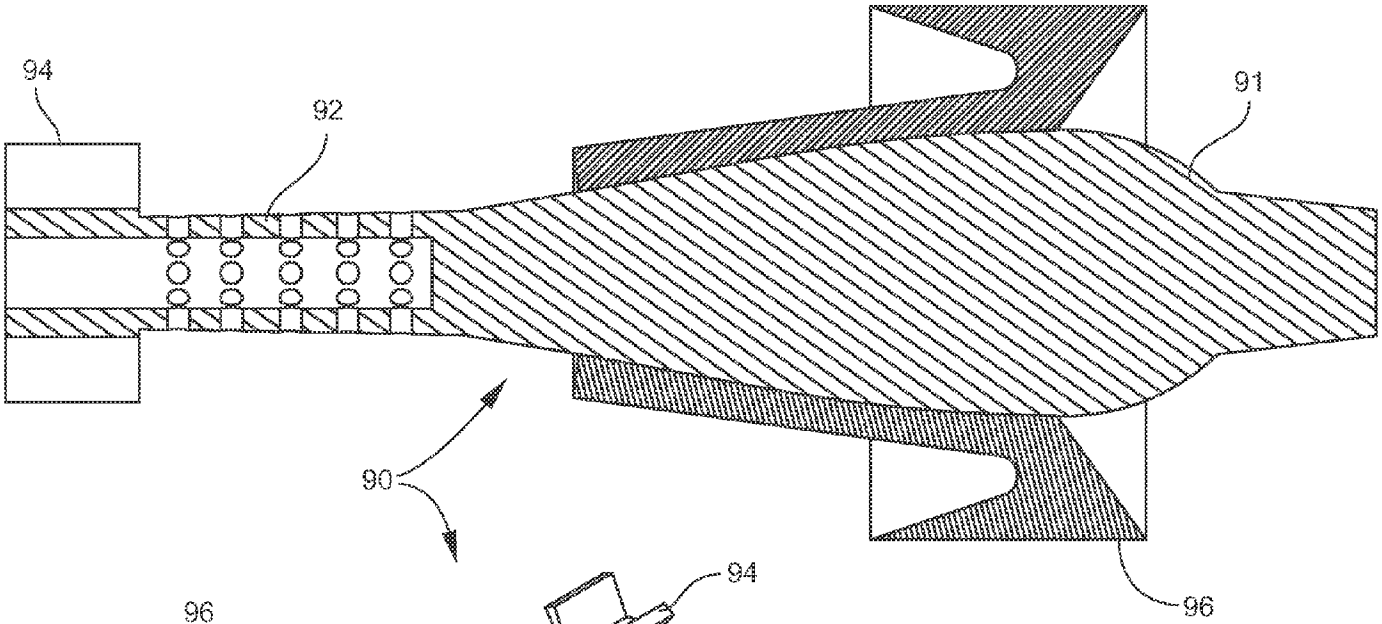
FIG. 9B is a longitudinal sectional view of the round of FIG. 9A.
Figure 9A:
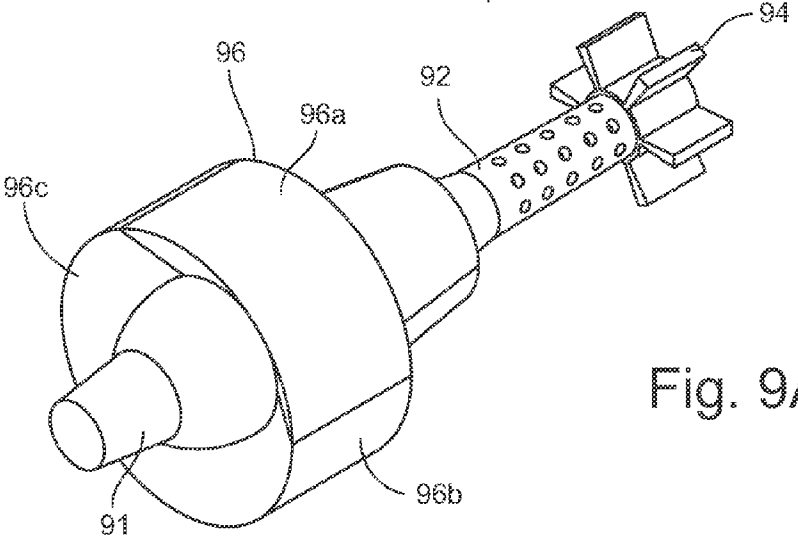
FIG. 9A is a perspective view of an embodiment of a fin-stabilized, muzzle-loaded mortar round with a discarding sabot.

FIG. 9A is a perspective view of an embodiment of a fin-stabilized, muzzle-loaded mortar round 90 having a projectile body 91, a tail boom 92, a fin assembly 94 and a discarding sabot 96 disposed on the projectile body 91. FIG. 9B is a longitudinal sectional view of the round 90 of FIG. 9A. Tail boom 92 may have an outer diameter substantially the same as the caliber of projectile body 91.

Round 90 (excluding sabot 96) may be, for example, a standard mortar round, such as an 81 mm M821 mortar round or a 60 mm M720 mortar round. Round 90 may be launched from a mortar tube larger than 81 mm, for example, a 120 mm mortar tube, by using sabot 96. Sabot 96 may be circumferentially divided into a plurality of discrete sabot increments 96*a*, 96*b*, 96*c*. The number of sabot increments may vary from at least two to as many as twenty-four.

FIG. 10A is a perspective view of a sabot increment 96*a* of the sabot 96. FIGS. 10B, 10C, and 10D are side, end and top views, respectively, of the sabot increment 96*a* of FIG. 10A. Sabot increments 96*a*, 96*b*, 96*c* may be mechanically connected to projectile body 91 with one or more of the structures (not shown in FIGS. 10A-D) and methods described with respect to sabot 26. Sabot increments 96*a*, 96*b*, 96*c* may be circumferentially mechanically connected to each other with the structure (not shown in FIGS. 10A-D) described with respect to sabot 26.

Figure 11B:
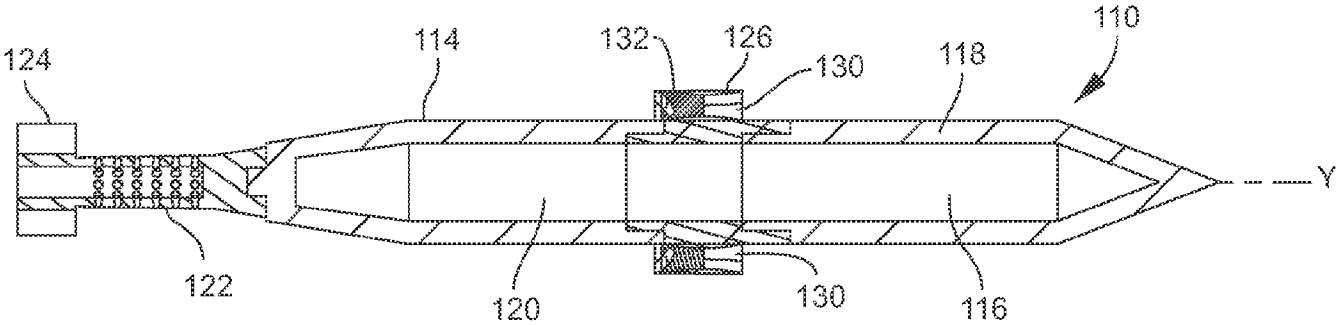
FIGS. 11B-11D are longitudinal sectional, front end and aft end views, respectively of the round of FIG. 11A.
Figure 11D:
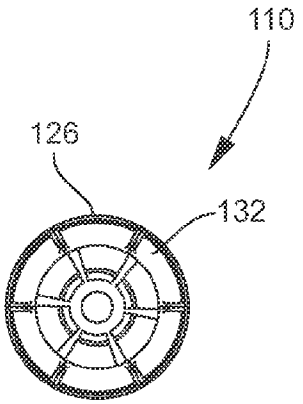
Figure 11C:
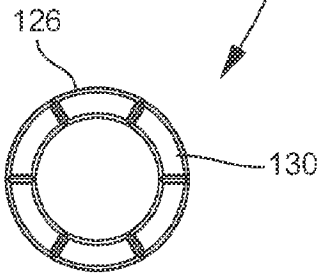
Figure 11A:
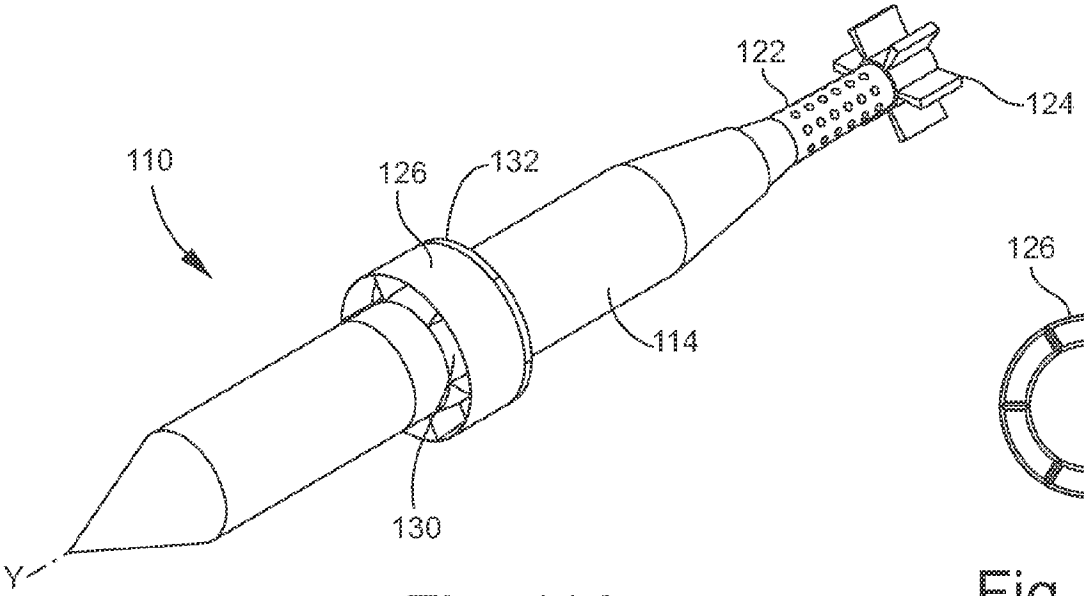
FIG. 11A is a perspective view of an embodiment of a fin-stabilized, muzzle-loaded mortar round having a sabot containing an annular nozzle.

FIG. 11A is a perspective view of an embodiment of a fin-stabilized, muzzle-loaded mortar round 110 having a central longitudinal axis Y. FIGS. 11B-11D are longitudinal sectional, front end and aft end views, respectively of the round 110 of FIG. 11A. Round 110 may be launched from mortar tube 12 (FIG. 2) having an inner diameter or caliber B. By way of example only, caliber B may be 120 mm, 81 mm or 60 mm.

Round 110 includes a sub-caliber projectile 114 having an interior volume 116 defined by a projectile wall 118. Projectile 114 may be centered on axis Y. A payload 120 may be disposed in the interior volume 116. Payload 120 may be, for example, high explosive material, smoke-producing material, etc. A tail boom 122 is fixed to an aft portion of the sub-caliber projectile 114. Propelling charges (not shown) may be disposed on tail boom 122 in a known manner. A fin assembly 124 is fixed to an aft portion of the tail boom 122.

A sabot 126 is disposed circumferentially around the sub-caliber projectile 114 and centered on the central longitudinal axis Y. Sabot 126 is a monolithic structure that defines an interior, annular, converging-diverging nozzle 130. Prior to launch of round 110, a plug 132 is inserted in an aft end of the nozzle 130. Plug 132 may also function as an obturator. Upon exit of the round 110 from the mortar tube 12, air pressure forces the plug 132 rearward out of the nozzle 130. The axial location of sabot 126 on projectile 114 depends on the effect (lift or drag) desired from the nozzle 130. Thus, sabot 126 may be axially placed at the center of gravity of projectile 114, or forward or aft of the center of gravity of projectile 114.

Figures 12A, 12B, 12C, 12D, 12E:
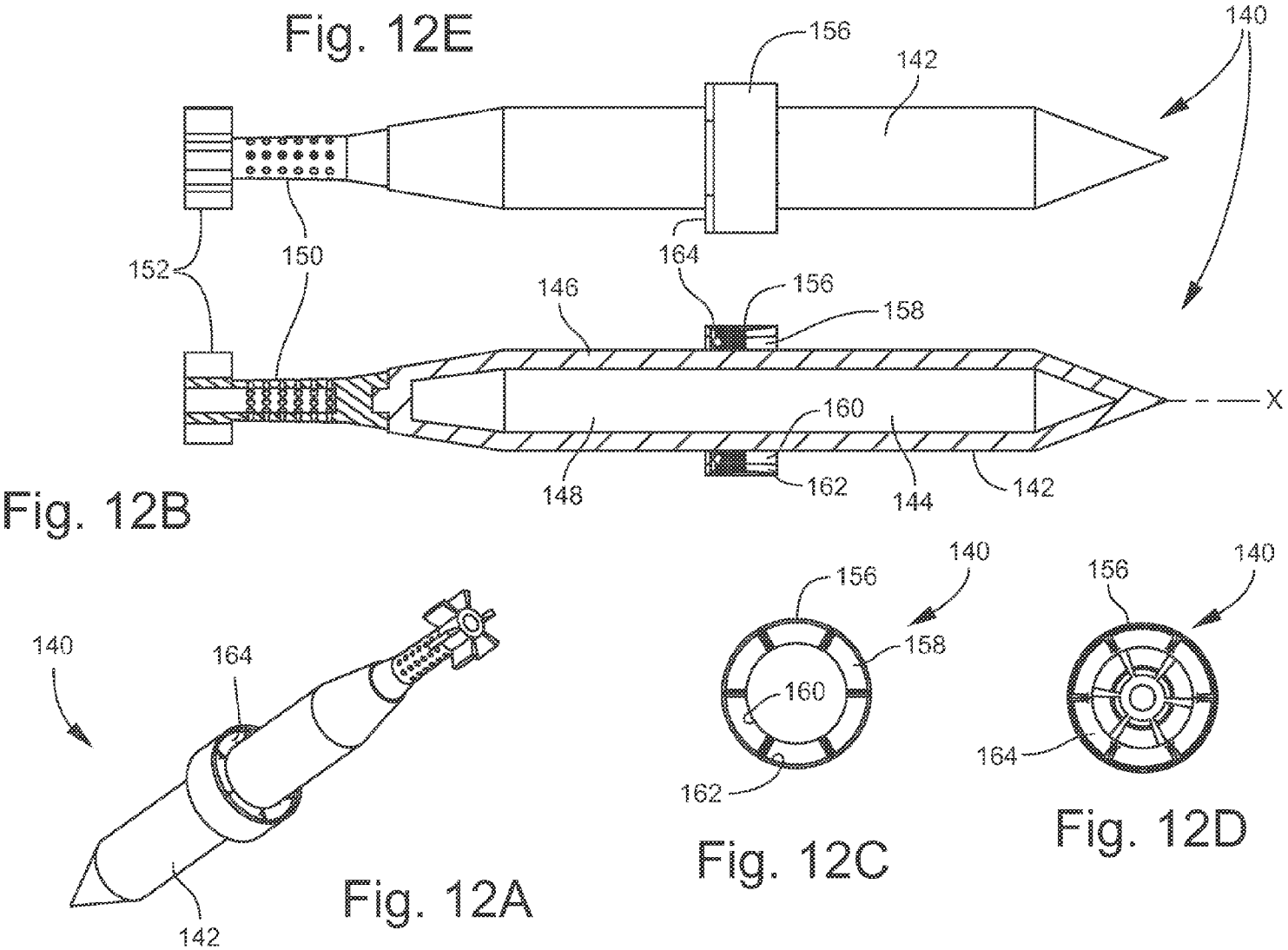
FIG. 12A is a perspective view of an embodiment of a fin-stabilized, muzzle-loaded mortar round having a sabot containing a variation of a nozzle.
FIGS. 12B-12E are longitudinal sectional, front end, aft end and side views, respectively of the round of FIG. 12A.

FIG. 12A is a perspective view of an embodiment of a fin-stabilized, muzzle-loaded mortar round 140 having a central longitudinal axis X. FIGS. 12B-12E are longitudinal sectional, front end, aft end and side views, respectively of the round 140 of FIG. 12A. Round 140 may be launched from mortar tube 12 (FIG. 2) having an inner diameter or caliber B. By way of example only, caliber B may be 120 mm, 81 mm or 60 mm.

Round 140 includes a sub-caliber projectile 142 having an interior volume 144 defined by a projectile wall 146. Projectile 142 may be centered on axis X. A payload 148 may be disposed in the interior volume 144. Payload 142 may be, for example, high explosive material, smoke-producing material, etc. A tail boom 150 is fixed to an aft portion of the sub-caliber projectile 142. Propelling charges (not shown) may be disposed on tail boom 150 in a known manner. A fin assembly 152 is fixed to an aft portion of the tail boom 150.

A sabot 156 is disposed circumferentially around the sub-caliber projectile 142 and centered on the central longitudinal axis X. Sabot 156 is a monolithic structure that defines an interior, annular, orifice 158. Orifice 158 includes a radially interior, linear surface or side 160. Linear side 160 may be defined by the projectile wall 146. Opposite from the linear side 160 is a converging-diverging side 162. Prior to launch of round 140, a plug 164 is inserted in an aft end of the orifice 158. Plug 164 may also function as an obturator. Upon exit of the round 140 from the mortar tube 12, air pressure forces the plug 164 rearward out of the orifice 158. The axial location of sabot 156 on projectile 142 depends on the effect desired from the orifice 158.

As alternatives to nozzle 130 and orifice 158, annular openings in sabots such as sabots 126, 156 may have other geometries as well. The annular openings may be used to maneuver the projectile, accelerate the projectile, or maintain the projectile's velocity using, for example, propulsion, scramjet or ramjet type orifices.

While the invention has been described with reference to certain embodiments, numerous changes, alterations and modifications to the described embodiments are possible without departing from the spirit and scope of the invention as defined in the appended claims, and equivalents thereof.

What is claimed is:

1. A muzzle-loaded, fin-stabilized mortar round for launching from a mortar tube having a caliber, comprising:

a central longitudinal axis;

a sub-caliber projectile including a circumferential outer surface centered on the central longitudinal axis and said sub-caliber projectile having an interior volume defined by a projectile wall and also centered on the central longitudinal axis;

a payload disposed in the interior volume;

a tail boom fixed to an aft portion of the sub-caliber projectile;

a fin assembly fixed to an aft portion of the tail boom; and a nondiscardable sabot having a nose end and an aft end and is disposed circumferentially around the sub-caliber projectile and centered on the central longitudinal axis, said sabot defining an essentially hollow metal cylinder supported equidistantly circumferentially by six essentially flat vanes aligned essentially vertically lengthwise with respect to oncoming air pressure during flight of said sub-caliber projectile, said vanes forming openings therebetween looking along said central longitudinal axis; and plugs inserted in the aft end of all said six openings of said sabot, to initially block launch pressurized gasses moving in the nose facing direction;

wherein upon exit of the round from the mortar tube, air pressure moving in the aft facing direction forces all the plugs rearward out of said sabot and such aft direction air pressure may thereafter flow through said sabot relatively unimpeded during flight of the round.

2. The round of claim 1 wherein upon exit of the round from the mortar tube, onrushing air pressure, having forced all the plugs rearward out of said sabot, may thereafter flow through said sabot and generates a forward thrust to said round.

3. The round of claim 2, wherein said sabot essentially forms a converging-diverging nozzle.

4. The round of claim 3, wherein said sabot includes a radially inner linear side and an opposing, radially outward, converging-diverging side.

5. The round of claim 2 wherein said sabot essentially defines an annular orifice centered on the central longitudinal axis.

* * * * *